US009157208B2

(12) United States Patent
Ong

(10) Patent No.: US 9,157,208 B2
(45) Date of Patent: Oct. 13, 2015

(54) ADJUSTABLE RAKED PILE DRIVER USING THE PUSH PULL METHOD

(76) Inventor: Chin Chai Ong, Kuala Lumpur (MY)

( * ) Notice: Subject to any disclaimer, the term of this patent is extended or adjusted under 35 U.S.C. 154(b) by 0 days.

(21) Appl. No.: 14/240,272

(22) PCT Filed: Jun. 14, 2012

(86) PCT No.: PCT/MY2012/000122

§ 371 (c)(1),
(2), (4) Date: Feb. 21, 2014

(87) PCT Pub. No.: WO2013/028055

PCT Pub. Date: Feb. 28, 2013

(65) Prior Publication Data

US 2014/0193210 A1 Jul. 10, 2014

(30) Foreign Application Priority Data

Aug. 22, 2011 (MY) ..... PI 2011003918

(51) Int. Cl.

| | |
|---|---|
| ***E02D 7/14*** | (2006.01) |
| ***E02D 7/20*** | (2006.01) |
| ***E02D 11/00*** | (2006.01) |

(52) U.S. Cl.
CPC .. *E02D 7/20* (2013.01); *E02D 7/14* (2013.01); *E02D 11/00* (2013.01)

(58) Field of Classification Search
CPC ..... E02D 7/20; E02D 7/14; E02D 11/00
USPC ..... 405/232; 173/52, 184
See application file for complete search history.

(56) References Cited

U.S. PATENT DOCUMENTS

2007/0144360 A1 6/2007 Heichel

FOREIGN PATENT DOCUMENTS

| | | |
|---|---|---|
| JP | 63223218 | 9/1988 |
| JP | 02030809 | 2/1990 |
| JP | 06193065 | 7/1994 |
| JP | 2002129566 | 5/2002 |
| JP | 2004156219 | 6/2004 |
| KR | 100792130 | 1/2008 |
| KR | 20080004222 | 1/2008 |
| RU | 2273694 | 4/2006 |
| WO | 2010059031 | 5/2010 |
| WO | 2011149332 | 12/2011 |

OTHER PUBLICATIONS

International Search Report for PCT/MY2012/000122, Completed by the Australian Patent Office on Aug. 23, 2012, 4 Pages.

*Primary Examiner* — Tara M. Pinnock
(74) *Attorney, Agent, or Firm* — Brooks Kushman P.C.

(57) ABSTRACT

A pile driver assembly consisting of a plurality of pile driver units interconnected together to a rigid base frame that uses the push and pull method to drive a group of raked piles. The pile driver units progressively push one pile at a time for a short distance into the ground while being pull down by the rest of the stationary driven piles in a repeated cyclical driving sequence until the required pile driving force is reached for every pile in the group. The pile driver assembly consists a plurality of interconnected pile driver units, a pile driver base adaptor, a pile clamping system and strong base frame to drive the piles in a two dimensional array of variously raked pile group from 1V:1H to true vertical in the z-axis and rotated to any angle in the x-y plane at a minimum pile's spacing of three times the pile's diameter.

20 Claims, 12 Drawing Sheets

Clamp force from vertical camps

Driving force creates clamp force

ADJUSTABLE RAKED PILE DRIVER USING THE PUSH PULL METHOD

CROSS-REFERENCE TO RELATED APPLICATION

Figure 1:
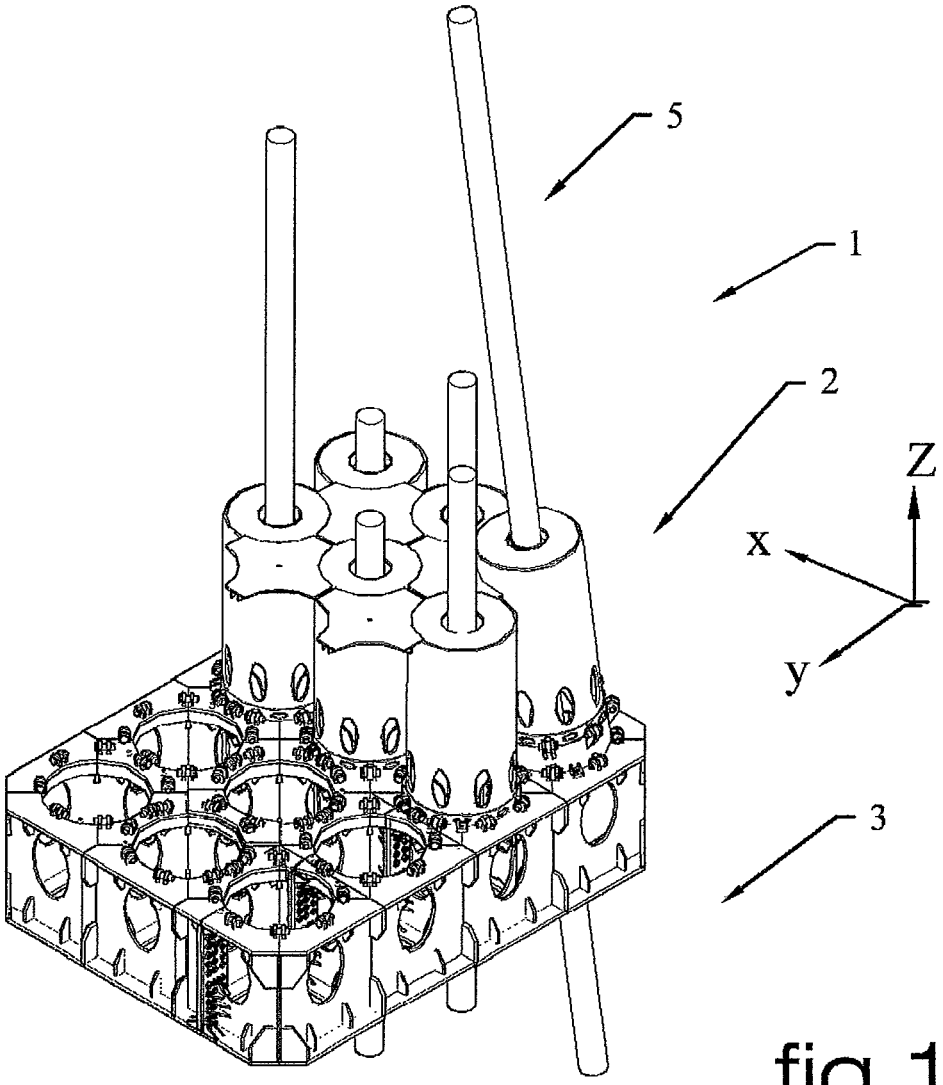

This application is the U.S. national phase of PCT Application No. PCT/MY2012/000122 filed on Jun. 14, 2012, which claims priority to MY Patent Application No. PI2011003918 filed on Aug. 22, 2011, the disclosures of which are incorporated in their entirety by reference herein.

1. TECHNICAL FIELD OF THE INVENTION

The present invention relates to a pile driver that can progressively drives a group of slanted piles at a minimum pile's spacing of three times the pile's diameter. In addition, within the pile group the individual pile can be variously raked from 1V:1H to true vertical in the z-axis and rotated to any angle in the x-y plane. This invention uses the push pull method and therefore is very compact and small without the need of heavy kentledge. However, it is also noted that the present invention can also be used to drive piles in any axis orientations even horizontally.

2. BACKGROUND OF THE INVENTION

By comparing existing moveable pile drivers, the advantage of the present invention is that the pile driver can drive all the piles within a pile group and yet selectively raked them to various degrees in any two axes. Whereas the existing prior arts using the push pull method used for driving sheet and tube piles in an alignment has drawbacks in that cannot raked piles in one or even two axes nor drive adjacent piles perpendicular to the alignment.

This present invention consists of a cluster of modular pile driver units with each overall cross-sectional dimension less than three times the pile diameter so that the driven pile's centre to centre spacing is at a minimum of three times the pile's diameter to reduce the pile cap size.

Further, unlike the common bulky heavy counter-reaction loads used in the prior arts like the hydraulic static pile driver, the present invention is very small and compact, therefore suited to drive piles in confined urban areas like in the road median with minimum traffic diversion, etc.

US20070144360A1 specifies a multiple press with adjustable spacing in a common horizontal rail; therefore it cannot drive raked piles in one or even two axes nor drive adjacent piles perpendicular to the alignment.

JP6-193065 teaches the common push pull pile driver in an alignment that comprises of at three pulling clamps held together in a rigid base frame to support and push the front pile; therefore it cannot drive raked piles in one or even two axes nor drive adjacent piles perpendicular to the alignment JP2002-129566 teaches the use of a single pull resistant pile assisting a push pile driver in addition to the push down force of the excavator. This method without more than two pull clamps to provide resistance against driving reaction force is limited by the maximum friction of the single pile which is insufficient if it encounters an obstruction or hard driving.

Korean patent 10-0792130 shows a pile being driven downwards with four resisting tension rods anchored into a common heavy slab. The four hold down tension rods is fixed and cannot be further driven. This prior art can only drive one central pile into the ground instead advancing a group of piles in a sequence into the ground as in push and pull method which theoretically gains increased combined frictional resistance as the piles penetrates into the ground.

JP2004-1562219A teaches the use of four driven stakes that is used as a reaction piles to provide resistance against the driving of a centrally located pile. These four exterior stakes may be screw piles which is usually large but shallowly embedded into the ground. There is no intention to use these shallow screw reaction piles as permanent piles as the centre permanent tabular piles must be driven deeper into more competent strata below.

JP63-23218 and JP02-030809 teaches pile driving using auxiliary anchor set in the position to the frame. As in the prior arts mentioned above, this method can only drive the central pile and cannot drive by advancing all the piles progressively into the ground like the push and pull method.

Korean patent 10-2008-0004222 teaches of an adjustable top and bottom pile guide that can slide along a frame in plane therefore raking the pile. However as compared to the present invention, it can only rake in one axis.

Russian patent 2273694C1 teaches of a method of stabbing the pile using four funnel piling guides positioned in subsea piling. The funnel piling guides are fixed in-line with the exterior axis of the legs of the jacket structure, but it did not teach that the four funnel piling guides can be further variably adjusted by rotating about the x-axis and y-axis as compared to the present invention.

PCT/MY2011/000054 teaches a pile swivelling clamp but faces the problem of the heavy clamps dropping downwards in relation to the centre of the clamp housing. The present invention overcomes this problem by providing a centralising plate that holds all the clamps centrally in relation to the top and bottom clamp housing by vertically compressed springs.

Therefore, in addition to overcoming the problems faced by the fore-mentioned prior arts, the present invention has the following advantageous features; compact pile driver units using powerful clamping system contained inside a compact body with peripheral lugs to be closely inter-connected by steel pins in dowel action to the modular base frame. In addition, the base of the frame can also be attached with a movable sliding base or powered track wheels to make the pile driver self-mobile.

To reduce the pile cap size, it is necessary that the group piles be driven at an optimum pile's centre to centre spacing of 3d (three times the pile's diameter or cross-section dimension). This is only possible if the pile driver unit has dimensions smaller than 3d so that the multiple pile driver units can be placed next to each other.

Conventionally, huge side pile clamps must be required to deliver a side clamping force of exceeding 5-7 times the driving force to avoid the pile/clamp interface slippage. With this present invention, the pile driver units does not require huge side pile clamps as in the prior arts because it can convert the vertical driving force directly through the sliding mechanisms of the wedges into a side horizontal clamping force.

Furthermore, it is the salient feature of this invention that through the use of a pile driver base adaptor, the pile driver units can be connected to the base frame raked from 1V:1H to a true vertical in the z-axis and be rotated to any angle in the x-y plane. This is particularly important for foundations that require lateral stability like piers and tall cantilever structures.

The modular frame based can also be configured to contain pile driver units arranged in a matrix of 1×3, 2×2, 3×2, 3×4, etc groups. The attachment of the modular base frame is held together by means of fasteners sufficient to cope with the bending of the base frame during pile driving.

The use of a circular or tabular housing to provide the transfer of jacking loads on to the clamping system and interconnected by a base frame is advantageous as is it is compact and sturdy system.

3. SUMMARY OF THE INVENTION

Accordingly an object of this present invention is to progressively drives a group of slanted piles at a minimum pile's spacing of three times the pile's diameter. In addition, within the pile group the individual pile can be variously raked from 1V:1H to true vertical in the z-axis and rotated to any angle in the x-y plane. The present invention can also be used to drive piles in any axis orientations even horizontally.

This wedge clamping system in this invention can convert the active vertical driving force into a side horizontal clamping force through the sliding mechanisms of the wedges thus avoiding the need place huge side clamps.

This push pull method is achieved through interactions of the inter-connected pile driver units via the rigid base frame. Unlike the heavy hydraulic static pile drivers, the present invention is light and transportable without the need of heavy kentledge and yet able to drive very high capacity piles. Therefore, it is suited to drive piles in confined urban areas like in the road median with minimum traffic diversion, etc.

According to the present invention, these objectives above are accomplished by the pile driver comprising of components:

a plurality of interconnected pile driver units, a pile driver base adaptor for raking the pile driver units, a centralised clamping plates for the pile driver unit, and a strong base frame to interconnect the pile driver units.

It should be appreciated that to maximise the potential of the present invention, the pile driver units can be interconnected to the modular base frame in a row or an array to drive group piles.

4. BRIEF DESCRIPTION OF THE DRAWINGS

Further understanding of the aspects of the present invention and their advantages will be discerned after studying the detailed description in conjunction with the accompanying drawings:

FIG. 1 Assembly of the pile driver inside the base frame

Figure 2:
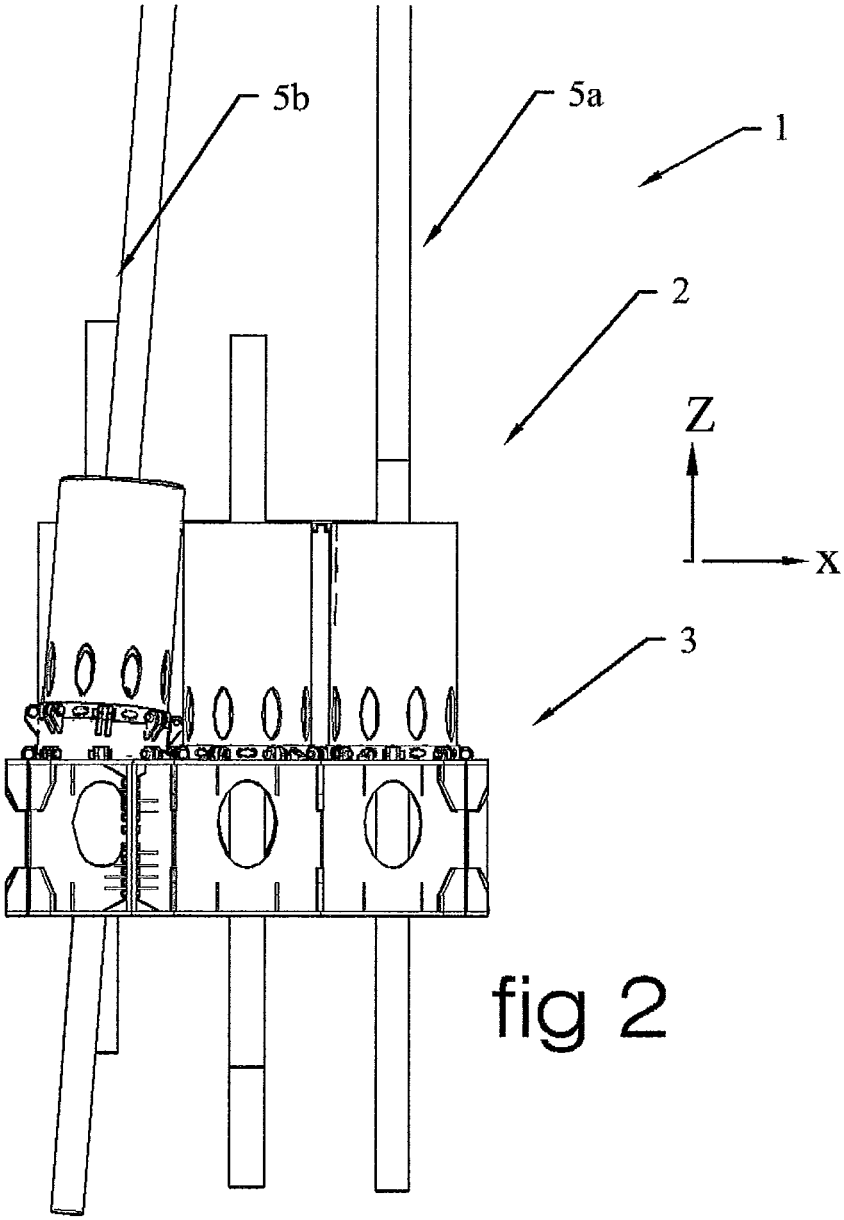

FIG. 2 Side view of the raked and vertical pile driver unit

Figure 3:
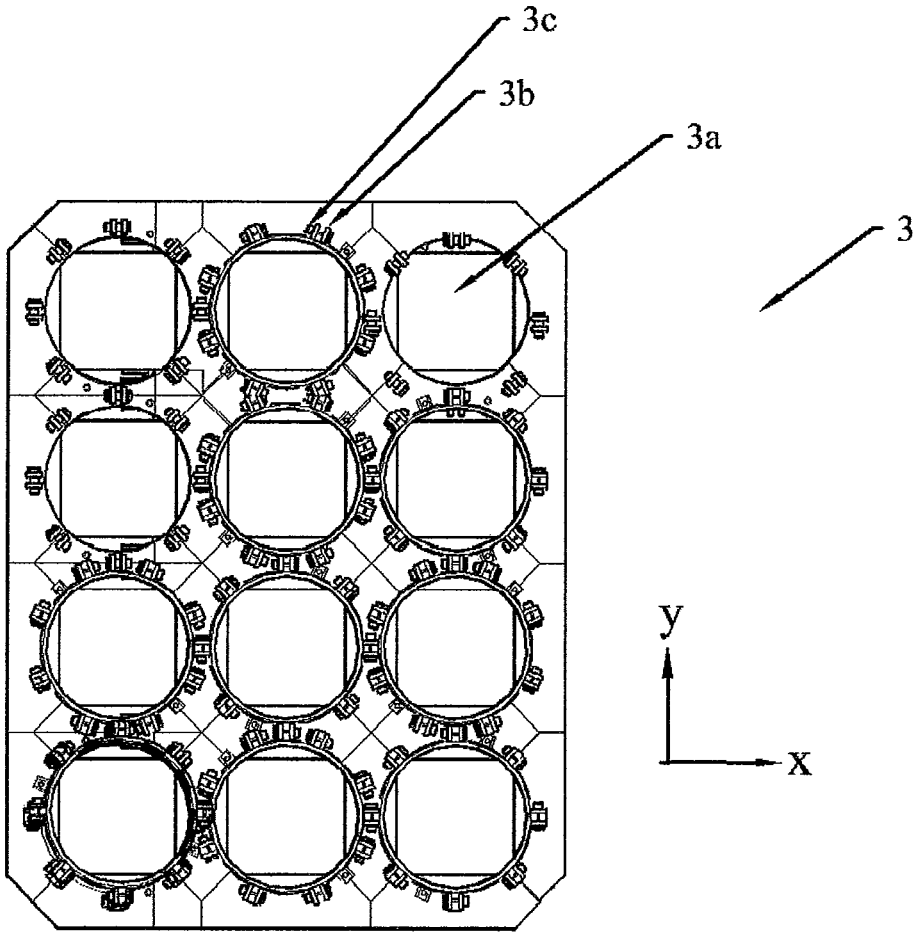

FIG. 3 Top View of the 3×4 base frame

Figure 4:
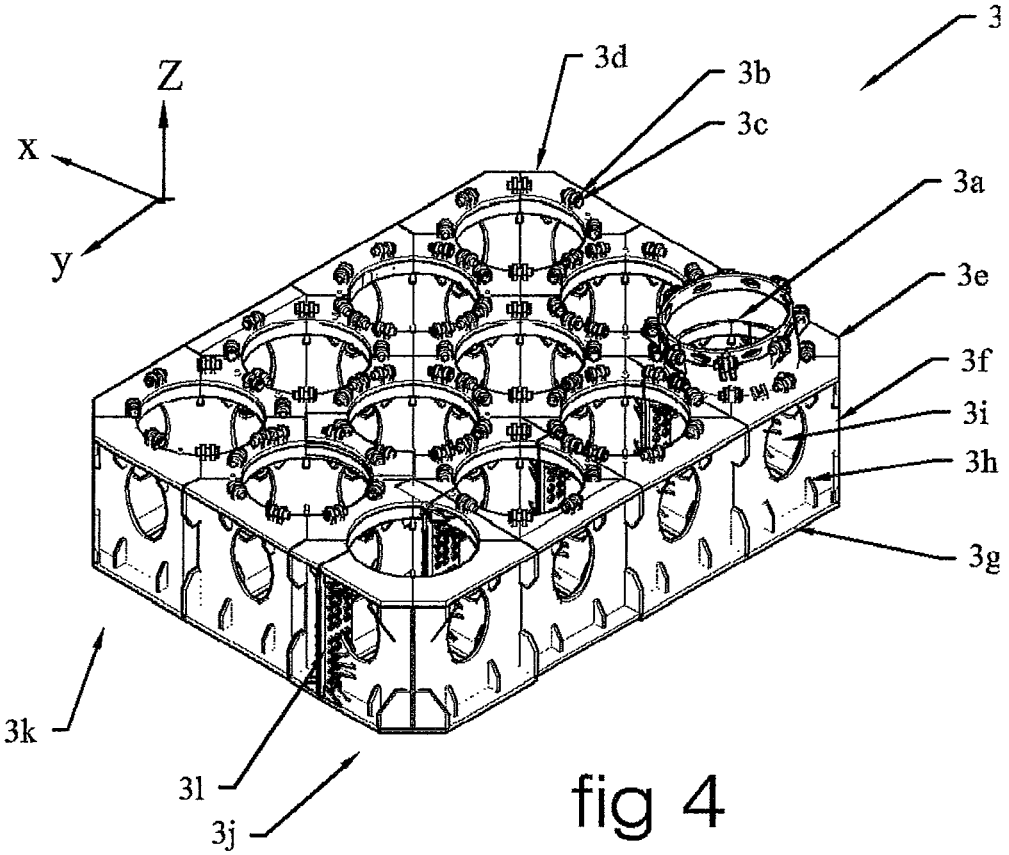

FIG. 4 3D view of the 3×4 base frame

Figure 5:
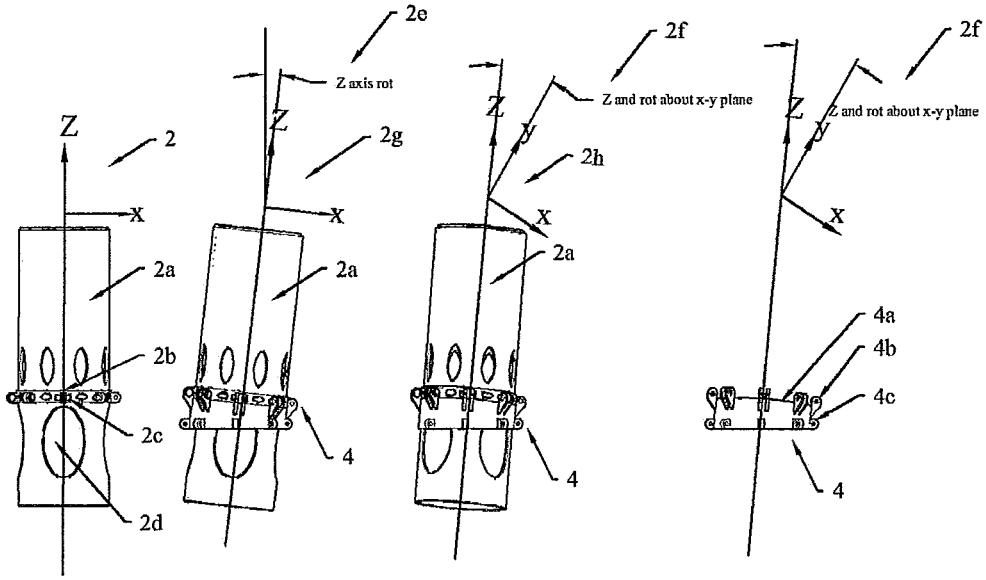

FIG. 5 Side view of the vertical and raked pile driver unit in the z-axis, pile driver unit and the pile driver base adaptor raked in the z-axis & rotated in the x-y plane.

Figure 6:
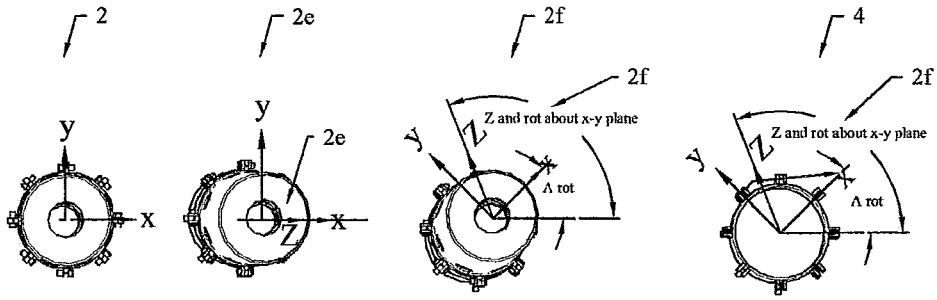

FIG. 6 Top view of the vertical and raked pile driver unit in the z-axis, pile driver unit and the pile driver base adaptor raked in the z-axis & rotated in the x-y plane.

Figure 7:
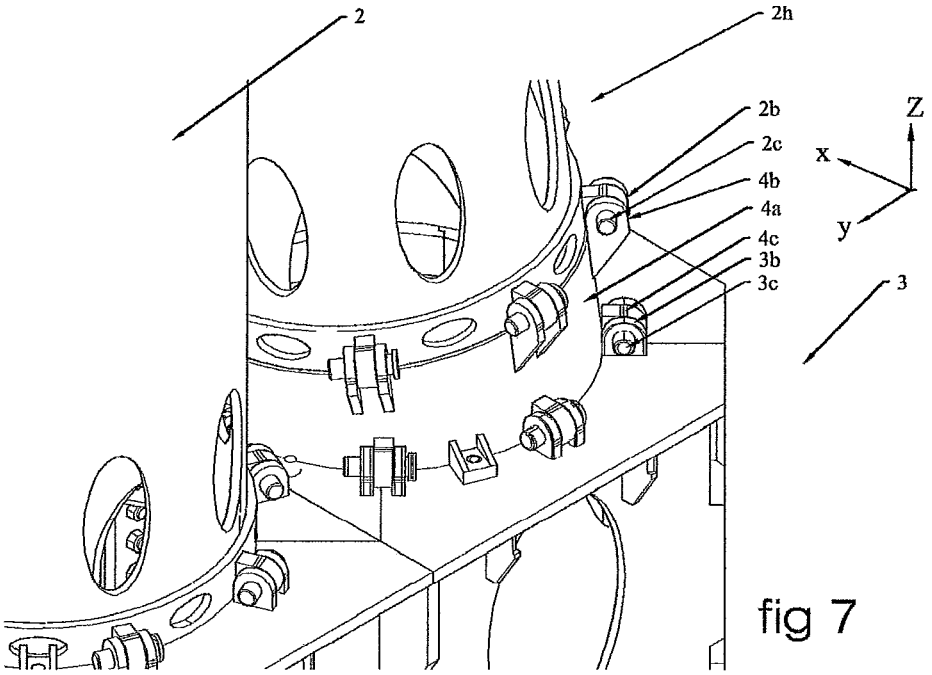

FIG. 7 3D view of the pile driver adaptor connected to the base frame.

Figure 8A:
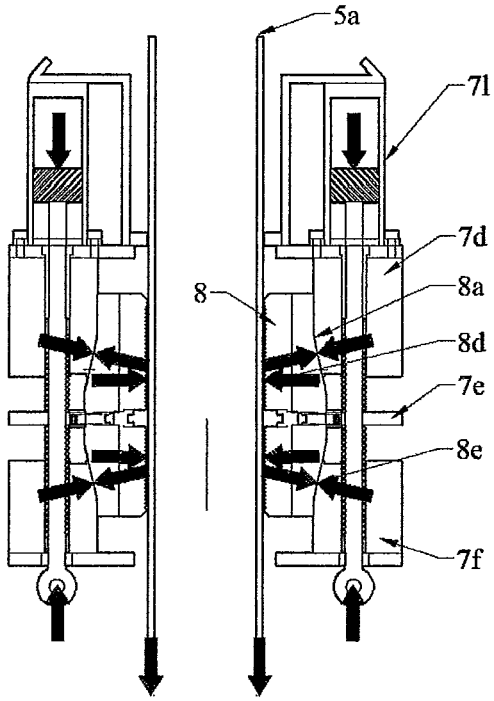

FIG. 8*a* Uniform horizontal clamping force derived from using the vertical clamp jacks.

Figure 8B:
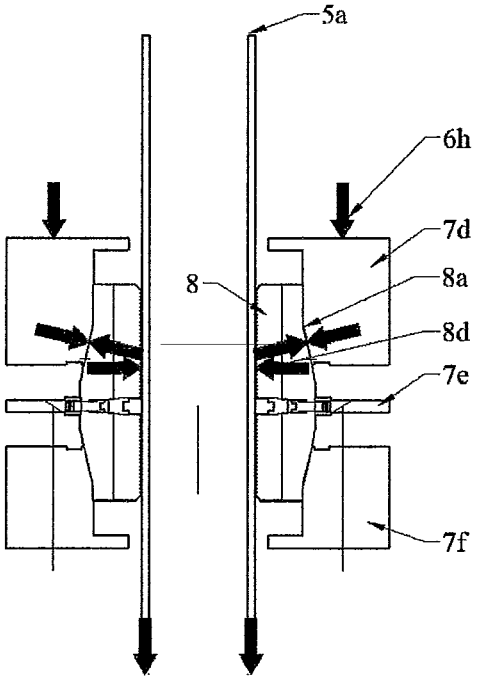
Figure 9:
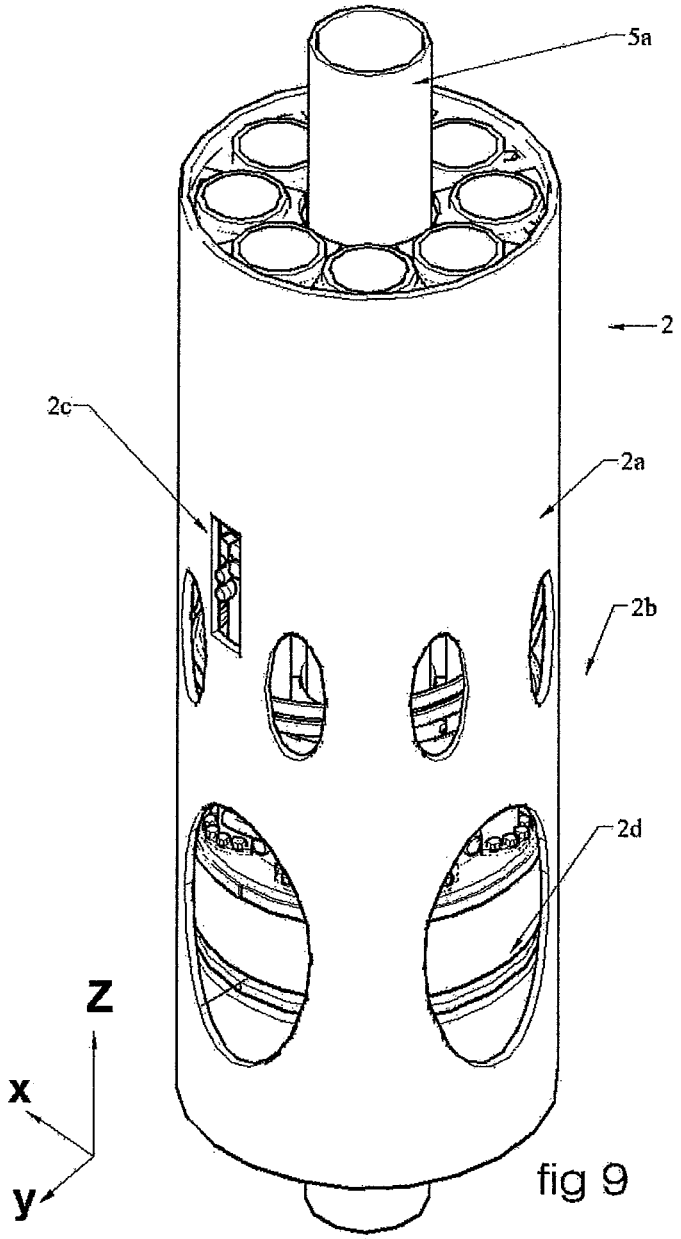
Figure 10:
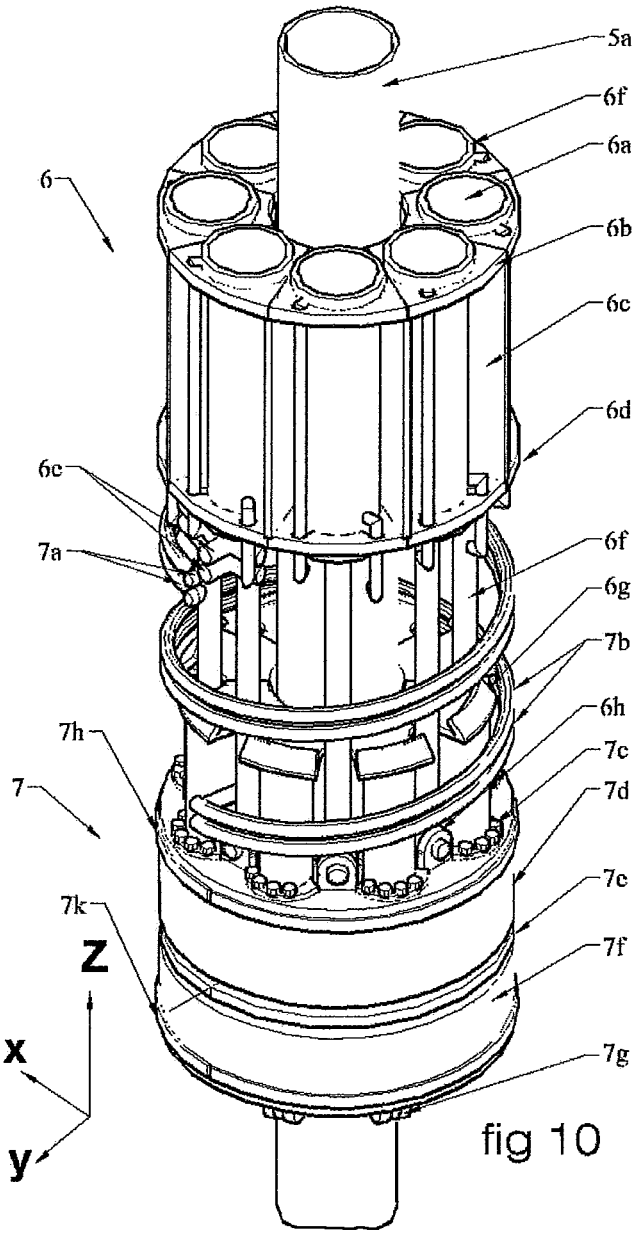
Figure 11:
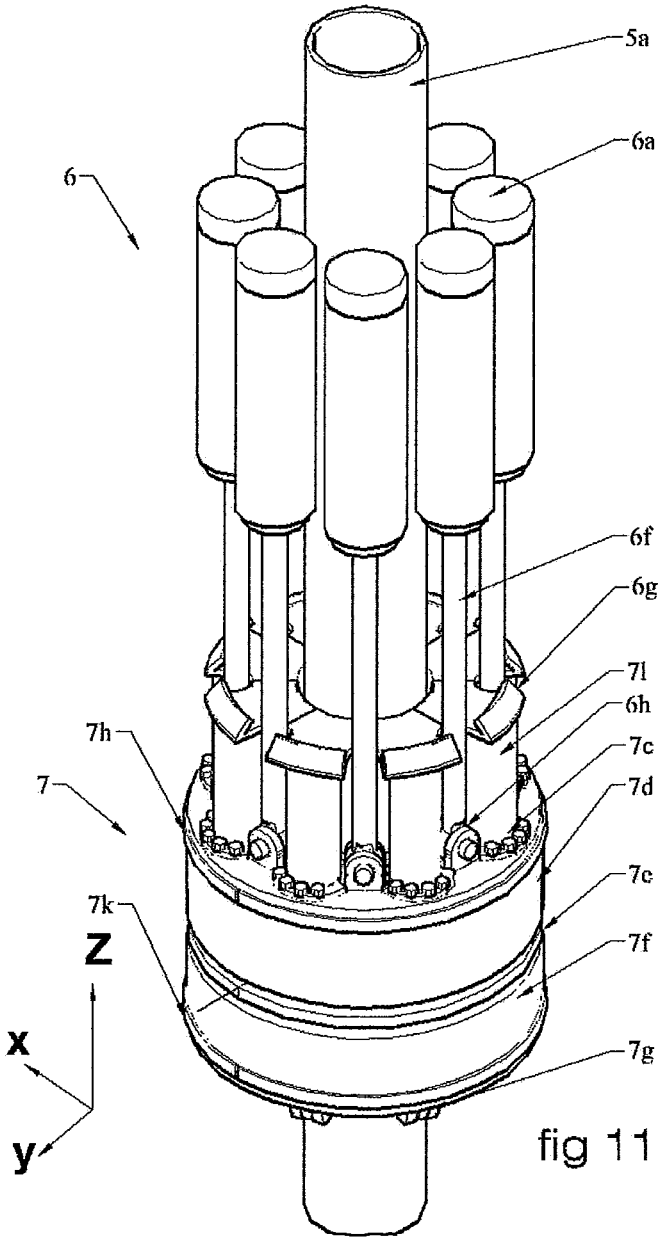
Figure 12:
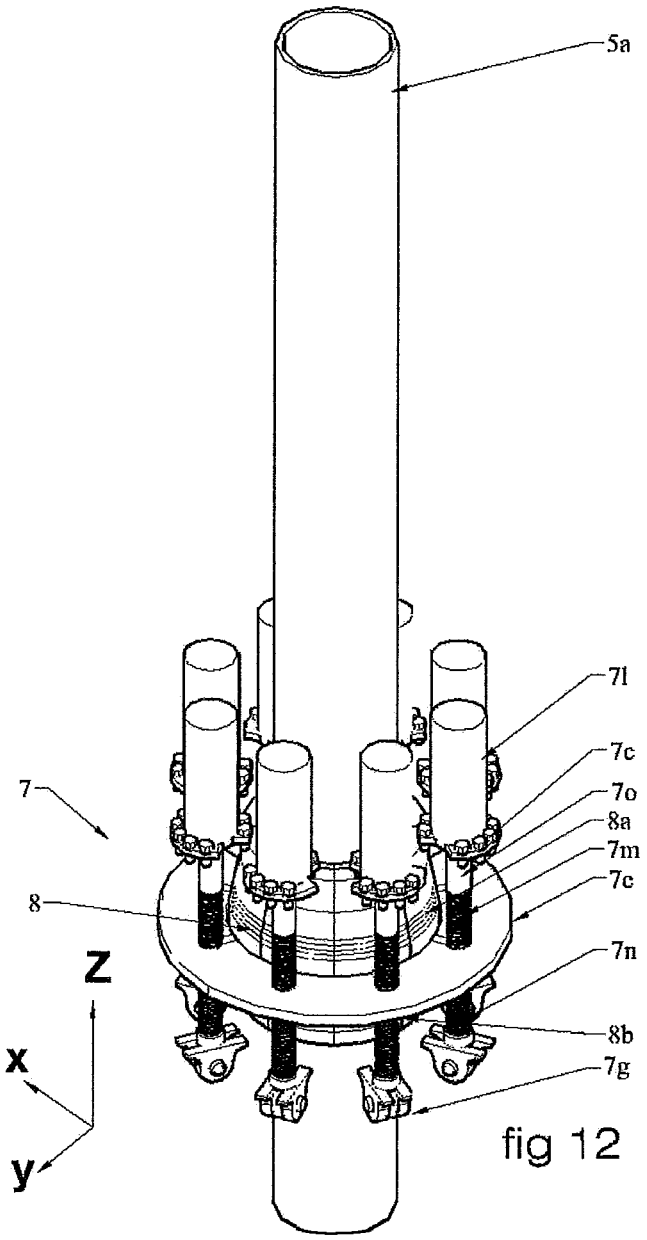

FIG. 8*b* Unbalanced beneficial horizontal clamping force created from the vertical clamp jacks FIG. 9 Typical pile driver unit FIG. 10 Typical pile driver unit with the outer tube removed FIG. 11 Typical pile driver unit with spiral hydraulic hose removed FIG. 12 3D view of the centralised clamp supported by compressed spring.

Figures 13, 14, 15:
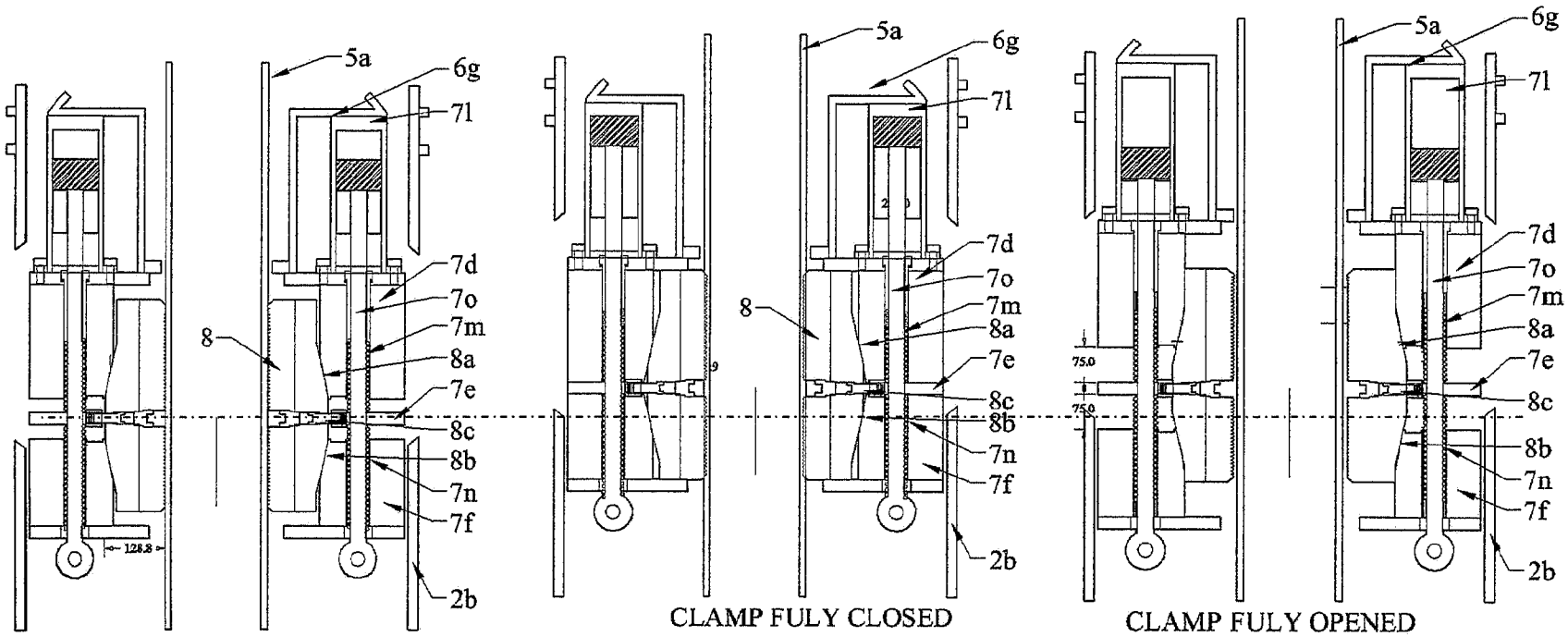

FIG. 13 Section view of the clamps during pile driving

FIG. 14 Section view of the clamps fully closed.

FIG. 15 Section view of the clamps fully opened.

Referring to the drawings, like numerals indicate like components to facilitate explanation. In order to differentiate two separate entities belonging to like components, a suffix "a" or "b" is used to denote the first and second entity.

The components of the pile driver(1) assembly consisting of a plurality of pile driver units(2) interconnected together to a rigid base frame(3). The FIG. 1 shows 6 nos of pile driver units(2) placed into the openings(3*a*) of the base frame(3). It will be appreciated that the pile driver units(2) can be placed at various raked positions as in FIG. 2 such that the piles(5*a*, 5*b*) can be driven individually slanted at different orientations. FIG. 3 shows a modular base frame with a configuration of 3×4 openings(3*a*). For reference, the local axis of the slanted pile driver unit(2) and global axis convention is shown as in FIG. 1.

Assembling of the pile driver unit(2) is shown in FIG. 4, the pile driver(1) is assembled by inserting the pile driver units(2) into the openings(3*a*) to match the peripheral lugs(2*b*) that is attached to the pile driver body(2*a*) between the twin lugs(3*b*) at the base frame(3). The pile driver units(2) are secured to the base frame(3) by lock pins(3*c*) through dowel actions on the lugs(2*b*,3*b*). The lugs(3*b*) and lock pins(3*c*) are arranged such that it can allow the pile driver unit(2) to be inserted under various rotated positions.

The top base plate(3*e*) and bottom base plate(3*g*) is attached together by the vertical central web(3*f*) to form an I-shaped beam box-structure in two directions to provide a rigid structural base frame(3) that can transfer the push and pull forces during driving. The edges of the base frame(3) are trimmed-off at the edges(3*d*,3*e*) to prevent obstructions during placement. To prevent local buckling of the base frame(3), steel plate wedges(3*h*) are used to stiffen the structure. The side opening(3*i*) of the base frame(3) and openings(2*d*) of the pile driver body(2*a*) is to allow a view of the pile clamps(6) during operations. It is also advantageous that the base frame (3) arrangement can be increased by adding base frame module(3*j*) to the main base frame(3*k*) through fasteners(3*l*) at the vertical central web(3*f*) of the base frame(3).

Assembling of a raked pile driver unit(2*e*,2*f*) is illustrated in FIG. 5, the pile driver unit(2*e*) can be connected to the base frame(3) being raked from 1V:1H to true vertical in the z-axis by using the pile driver base adaptor(4). The pile base adaptor (4) has two unparallel edges which give rise to this rake angle when placed into the opening(3*a*). As shown in FIG. 7, the pile driver unit(2*e*) is inserted into the pile driver adaptor(4) to match the peripheral lugs(2*b*) to the pile driver adaptor's 215 twin lugs(4*b*) that is attached to the pile driver adaptor body (4*a*) and secured by lock pins(2*c*) through dowel actions on the lugs(2*b*,4*b*). The pile driver adaptor(4) is in turn securely attached to the base frame(3) by lock pins(2*c*) through dowel actions on the engaging lugs(4*c*) attached to the pile driver body(4*a*) with the twin lugs(3*b*) of the base frame(3). Further, by rotating pile driver base adaptor(4) about the x-y plane, the pile driver unit(2*f*) became raked in the z-axis and rotated about the x-y plane as shown in FIG. 6. It is expected that the driven pile(5*b*) will follow suit to the axis of the respective raked pile driver unit(2*e*,2*f*).

In the method of pull and push, the pile driver(1) progressively drive the piles(5) in a sequence according to the following manner; the first pile(5) is inserted into the individual pile driver unit(2), the pile clamps(8) is opened to allow the driving hydraulic jacks(6) to retract up, the pile clamps(8) is then closed to grip the pile(5), followed by extending the driving hydraulic jacks(6) downwards to advanced the pile(5) for a short stroke into the ground, after which this piling process is repeated for the next adjacent piles(5), and when this cycle is completed for all the piles(5) inside the base frame(3), the whole cycle is re-continued again with the first pile until all the piles(5) are driven to the required force. Theoretically, the driven piles(5) gains from strength to strength as it progressively penetrates into the ground after each cycle with increasing combined frictional pull resistance to push the next pile(5).

Pile clamping mechanism of the pile driver unit(2) is shown in FIG. 8*a*, the clamps(8) movements is controlled by the vertical clamping jacks(7*l*) that is attached to the upper circular clamp body(7*d*) by bolts(7*c*) and the lower circular clamp body(7*f*) is held together by the vertical hydraulic rod(7*o*) at the base lug(7*g*). When the vertical clamping jacks (7*l*) is retracted, the lower circular clamp body(7*f*) is lifted up against the upper circular clamp body(7*d*) causing a constriction at interface contacts(8*a*, 8*e*) which pushes the clamp(8) towards the centre resulting in uniform clamping horizontal force acting on the pile(5*a*). In the opposite situation, when the vertical clamping jacks(7*l*) is extended it moves the lower circular clamp body(7*f*) downwards away from the upper circular clamp body(7*d*) releasing the constriction at interface (8*a*, 8*e*) thereby reducing the clamp horizontal force.

When the pile(5*a*) is pre-clamped in the driving mode, pile driving force applied from the driving hydraulic jack(6) through the jack rod(6*f*) connected to the jack rod base(6*h*) located at the top of the upper clamp body(7*d*) will result in a reaction force at the interface contact (8*a*) which causes an beneficial unbalanced horizontal force on to the clamp(8). In this way the pile driving force applied from the driving hydraulic jack(6) can create additional a horizontal force on to the clamp(8). This resultant clamping force derived from the driving hydraulic jack(6) creates an imbalance clamping horizontal force, hence the upper portion of the clamp(8) is extended longer than the lower portion of the clamp(8) so that a more uniform horizontal pressure acting on the pile(5)

The typical pile driver unit(2) is shown in FIG. 9 with an inserted pile(5*a*) inside the pile driver body(2*a*) with openings(2*c*) for the hose connections to the driving hydraulic jack(6) and the vertical clamping jack(7*l*). The driving hydraulic jacks cylinders(6) is located inside at the top sections of the pile driver body(2*a*) and secured to it by top screws(6*f*) to the top plate(6*b*). The top plate(6*b*), bottom plate(6*d*) and vertical plate(6*c*) is welded to the pile driver body(2*a*), The assembly containing the plurality of driving hydraulic jacks(6), vertical clamping jack(7*l*) and clamping system(7) as shown in FIG. 11 must be inserted into the pile driver body(2*a*) through the base.

The FIG. 12 shows the clamps(8) is attached to centralising plate(7*e*) by pins(8*c*) which is supported in the z-axis position by separate lower compressed springs(7*n*) and upper compressed springs(7*n*) around the vertical clamping rods(7*o*). In absence of this centralising plate(7*e*), when the vertical clamping jacks(7*l*) is extended the clamps(8) would fall downwards due to its self-weigh into the lower circular clamp body(7*f*) and would not align to the central position of the clamping system(7).

The FIG. 13 shows the cross-section view through the vertical clamping jacks(7*l*) when the pile(5*a*) is being clamped. Whereas the FIG. 14 shows the further movements inwards of the clamps(8) when the vertical clamping jacks(7*l*) is fully retracted. In the opposite situation in FIG. 15, the clamps(8) are fully opened resulting in the widening of the clamps and releasing of the pile(5*a*).

The invention claimed is:

1. A pile driver that uses a push and pull method to drive a group of raked piles by progressively pushing one pile at a time for a short distance into the ground while being pulled down by the rest of the stationary driven piles in a repeated cyclical driving sequence until the required pile driving force is reached for every pile in the group, the pile driver comprising:

a plurality of interconnected pile driver units, a pile driver base adaptor, a pile clamping system, and a rigid base frame wherein the pile driver can drive all the piles in a two dimensional array of variously raked piles from about 45° to true vertical in the z-axis and rotated to any angle in the x-y plane at a minimum pile's spacing of three times a pile's diameter.

2. The pile driver of claim 1 wherein the plurality of pile driver units are interlocked together with the rigid base frame.

3. The pile driver of claim 1 wherein the plurality of pile driver units further comprise a plurality of driving hydraulic jacks and vertical clamping jacks.

4. The pile driver of claim 1 wherein the pile driver units have a tabular pile driver body with one of a circular, square, rectangular or regular cross-sectional shape that can closely contain a plurality of driving hydraulic jacks and vertical clamping jacks.

5. The pile driver of claim 4 wherein the pile driver units have a pile driver body which has an overall cross-sectional dimension of less than three times a diameter of the pile.

6. The pile driver of claim 1 wherein the rigid base frame is modular and can be assembled together by attaching a base frame module to a main base frame with a plurality of fasteners.

7. The pile driver of claim 1 wherein the pile driver units are securely interlocked together to a rigid modular base frame by means of dowel pins engaging with peripheral lugs that are attached to the pile driver unit and snugly fitted in between twin lugs at the base frame.

8. The pile driver of claim 1 wherein the pile driver units can be raked in the z-axis by using a pile driver adaptor with two non-parallel cross-section planes to connect to the rigid base frame.

9. The pile driver of claim 1 wherein the pile driver units can be raked in the z-axis and rotated in the x-y plane by rotating the pile driver adaptor through an angle in the x-y global axis with two non-parallel cross-section planes to connect to the base frame.

10. The pile driver of claim 1 wherein the pile driver unit is inserted into the pile driver adaptor to align peripheral lugs on the pile driver unit with twin lugs attached to the pile driver adaptor and locked together through dowel pins engaging the peripheral lugs with the matching twin lugs.

11. The pile driver of claim 10 wherein the pile driver adaptor is secured to the rigid base frame by dowel pins engaging lugs attached to the pile driver unit with the twin lugs on the base frame.

12. The pile driver of claim 1 wherein the pile clamping system further comprises a centralizing plate that maintains alignment of the clamps at a central position around a plurality of vertical clamping jacks connected to an upper circular clamp body by bolts and a lower circular clamp body by a vertical hydraulic rod attached to a lower circular clamp body through a pinned connection.

13. The pile driver of claim 12 wherein the centralizing plate is supported in the z-axis position by separate lower compressed springs and upper compressed springs around vertical clamping rods in order to always maintain the alignment of the clamps at a central position of the pile clamping system.

14. The pile driver of claim 12 wherein the clamps are attached around the inner side of the centralizing plate by means of pins.

15. The pile driver of claim 1 wherein the pile driver unit further comprises a driving hydraulic jack that can create an additional beneficial clamping horizontal force through a reaction force at the interface contact resulting in a reaction horizontal force on to the clamp when the pile is pre-clamped.

16. The pile driver of claim 15 wherein the clamps have an extended portion in an upper part to cope with the additional clamping horizontal force created during pile driving with a more uniform horizontal pressure acting on the pile.

17. The pile driver of claim 1 further comprising a movable sliding base or powered track wheels attached to the rigid base frame to make the pile driver self-mobile.

18. The pile driver of claim 1 wherein interconnected pile driver units securely clamp a pile without slippage and slide up and down inside a pile driver body having a top slider located in an upper circular clamp body and a bottom slider located on a lower circular clamp body.

19. A method of the push and pull pile driving, comprising:

driving a group of raked piles into a two dimensional array with the piles variously raked from about 45° to true vertical in the z-axis and spaced apart in the x-y plane at a minimum pile spacing of three times a pile's diameter; and clamping the piles together through an assembly of interconnected pile driver units attached to pile driver adaptors on a rigid base frame using dowel pins extending through engaging lugs formed on the pile driver units, the pile driver adaptors and the rigid base frame.

20. The method of claim 19 wherein during pile driving the assembly of interconnected pile driver units attached to pile driver adaptor supports the raked piles on to the rigid base frame to drive the pile along any desired axis even horizontally.

* * * * *